US006485018B2

(12) United States Patent
Lorenz et al.

(10) Patent No.: US 6,485,018 B2
(45) Date of Patent: Nov. 26, 2002

(54) BALL-CONTAINING PLAY TABLE FOR CHILDREN'S PLAY AREAS

(76) Inventors: Volker Lorenz, Gaussstr. 45 B, 70193 Stuttgart (DE); Philipp Schnizer, Brühlwiesenweg 7, 72531 Hohenstein (DE)

( * ) Notice: Subject to any disclaimer, the term of this patent is extended or adjusted under 35 U.S.C. 154(b) by 0 days.

(21) Appl. No.: 09/899,620

(22) Filed: Jul. 5, 2001

(65) Prior Publication Data

US 2002/0008354 A1 Jan. 24, 2002

(30) Foreign Application Priority Data

Jul. 6, 2000 (DE) ..... 100 33 006
Feb. 23, 2001 (EP) ..... 01104612

(51) Int. Cl.[7] ..... A63F 7/00; A63F 7/36
(52) U.S. Cl. ..... 273/110; 273/112; 273/118 R
(58) Field of Search ..... 273/110, 112, 273/113, 118 R

(56) References Cited

U.S. PATENT DOCUMENTS 162,141 A * 4/1875 Bayles ..... 273/110
3,764,134 A 10/1973 Reinersten
3,815,917 A * 6/1974 Brown ..... 273/110
3,822,885 A * 7/1974 Domka et al. ..... 273/110
3,829,096 A * 8/1974 Gioia et al. ..... 273/110
3,844,562 A * 10/1974 Foley et al. ..... 273/110
4,257,600 A * 3/1981 Goldfarb ..... 273/110
4,673,182 A * 6/1987 Bowen ..... 104/305
4,693,476 A * 9/1987 Talamantez, Sr. ..... 273/110
4,759,547 A * 7/1988 Shin-Tao ..... 273/109
5,042,808 A 8/1991 Shoptaugh
5,607,155 A 3/1997 Campbell
5,749,575 A 5/1998 German

FOREIGN PATENT DOCUMENTS

DE 81 23 017 U1 12/1981
WO WO94/11072 A1 5/1994

* cited by examiner

*Primary Examiner*—Raleigh Chiu
(74) *Attorney, Agent, or Firm*—Alston & Bird LLP

(57) ABSTRACT

A play unit for moving at least one rolling element (14), having a considerably horizontal, changeable-inclination play surface (11) on which a rolling element (14) is guided and moves in dependence on the inclination of the play surface (11), the play unit being designed as a play table, of which the play surface (11) is mounted on a base (B) via a bearing device (F).

21 Claims, 3 Drawing Sheets

BALL-CONTAINING PLAY TABLE FOR CHILDREN'S PLAY AREAS

BACKGROUND OF THE INVENTION

The present invention relates to play units that have a generally horizontal, changeable-inclination play surface on which a rolling element is guided and moves in dependence on the inclination of the play surface.

Play units of the above-described type which have wooden panels with ball running tracks milled therein are known. The play units are hand-held in order, by virtue of manual changes in inclination of the play unit out of the horizontal (in extreme cases into the vertical), for one or more balls to be moved through the ball running tracks. In a modified configuration, the play unit can be moved, as a balancing game, by the feet. These known play units are only designed for private use.

SUMMARY OF THE INVENTION

One aspect of the present invention is the provision of an improvement to play units of the type described above. In accordance with this aspect, a play table is provided that includes a generally horizontal play surface mounted on a base via a bearing device so that the play surface can be moved between a plurality of inclinations while mounted to the base. Further in accordance with this aspect, at least one rolling element is guided and moves on the play surface in dependence on the inclination of the play surface.

Since the play surface is mounted on a base via a bearing device, the base is able to bear the dead weight of the play surface. The change in inclination of the play surface, i.e. the balancing, is no longer as tiring for the user. It is possible to have larger dimensions for this robust, free-standing play unit, for example longer running tracks for the rolling element. The play unit is thus also suitable, for example, for public-access areas, for example children's play areas in banks, department stores, airports, etc., where the play unit is prevented from being taken away by virtue of its weight, which may be increased by an additionally weighted base, and possibly, in addition, by virtue of fixed installation of the base, for example using screw-connections. The play unit may consist of wood, wood-based materials, plastic or combinations thereof. The play unit according to the invention is beneficial for the coordination, dexterity, fine motor skills and concentration of children.

The bearing device preferably bears the play surface, that is to say it absorbs the weight thereof, and preferably contains a tilting mechanism, for example with a restoring means, this making it possible, with a change in inclination of the play surface out of a starting position, for the play surface to be deflected in a certain solid-angle range, for example through 30° from the starting position, depending on the application of force. For this purpose, the bearing device may have, for example, a spring, which can be subjected to bending stress and, at the same time, ensures a restoring action, or a joint, for example a ball-and-socket joint or cardan joint, it being possible to provide a rigid pendulum on the underside of the play surface for the restoring action. The bearing device preferably has, in addition, a damping element, in order that deflections of the play surface are damped more quickly and the risk of injury is thus also reduced. A certain safeguard against injury is already provided by the play table having a larger diameter than the bearing device (and/or the shank of the base) in conjunction with the bearing device being arranged on the underside of the play surface. A preferred sheath of the bearing device then safeguards reliably against manipulation of the bearing device and against injury being caused by the same. Depending on the material, the sheath may form the damping element at the same time.

The play surface is preferably fitted releasably on the bearing device and can be exchanged as a module. The modular construction makes it possible for the play-unit provider to exchange the play surface for another variant at any time. Said variant may be of a different color or colors and set new tasks. The long-term attractiveness of the play unit is considerably increased as a result.

The rolling element, for example one or more balls, small cars or trains, is preferably prevented from being taken away in that it is moved within a closed system in the region of the play surface. This is achieved, for example, by a transparent panel above the play surface and by closed return guides. At the same time, the situation where other components and accessories are removed or lost is thus also ruled out.

Preferably provided on the underside of the play surface is at least one return guide along which the rolling element can be moved from a target point on the play surface to a starting point on the play surface. In the case of a ball, the latter disappears from the top side of the play surface in one or more bores, as it reaches the target point or leaves the predetermined ball running track, is guided along the underside and led to the starting point by a lever mechanism, a spring-loaded bolt or by corresponding curvature of the return guide in conjunction with the inclination of the play surface. This increases the attraction of the game to a considerable extent.

In order not to be restricted to wood or the like alone, it is possible to provide on the top side of the play surface regions of different heights which are intended for guiding the rolling element and are made in material which is of different colors at different heights. With wood, plywood panels, multi-layered plastic or some other material which is correspondingly provided with color throughout, and into which the running tracks are milled, numerous esthetically pleasing color variations are thus possible. The running track appears as a groove which is of a different color from the rest of the top side of the play surface. Even if the running track is worn by a lot of use, the original color is maintained. The materials used as well as the coloring and shaping give the free-standing play unit an original and distinctive appearance.

BRIEF DESCRIPTION OF THE DRAWINGS

Figure 1:
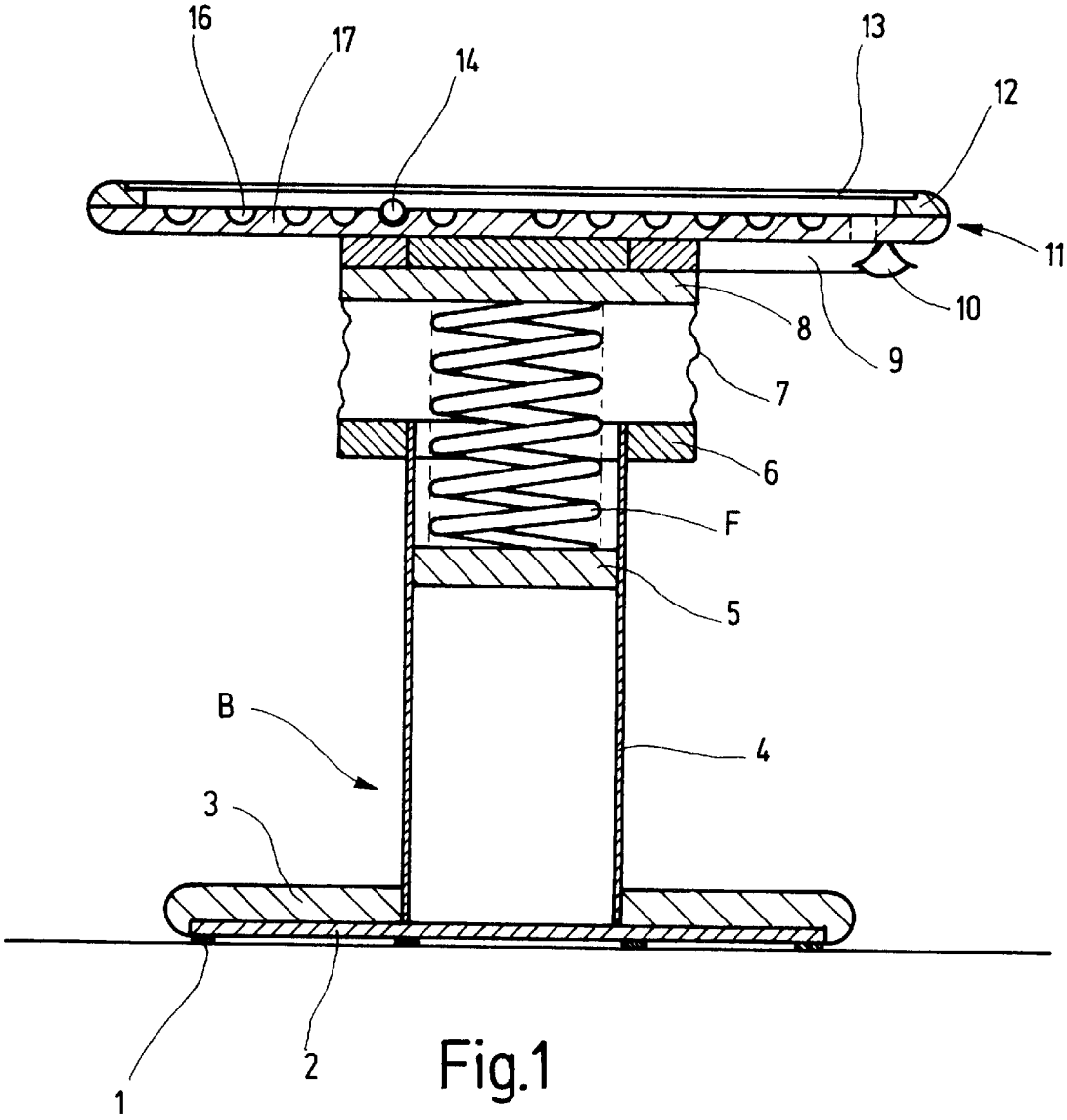
Figure 2:
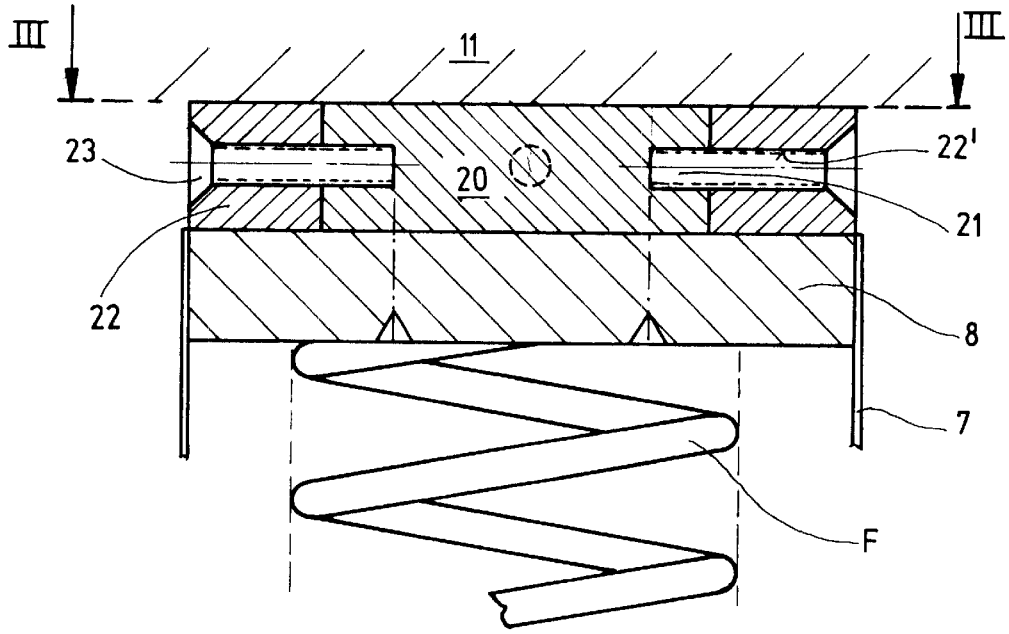
Figure 3:
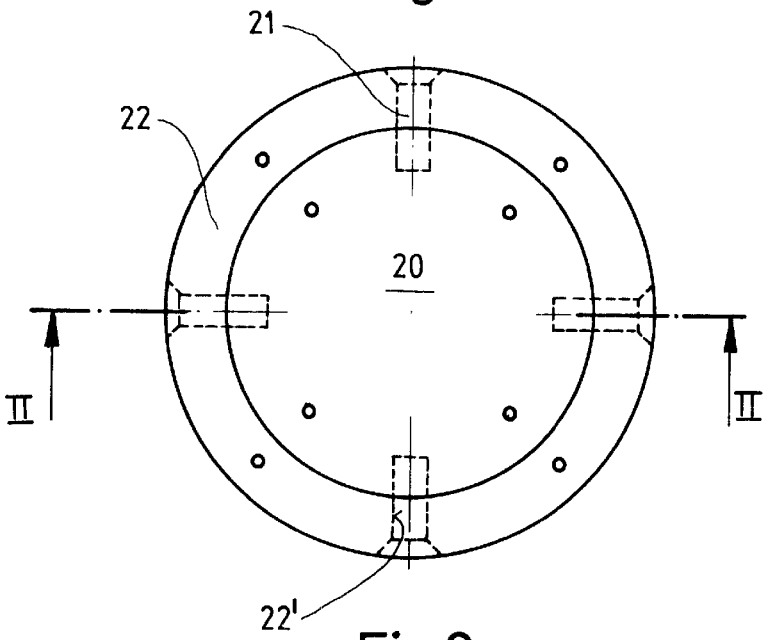
Figure 4:
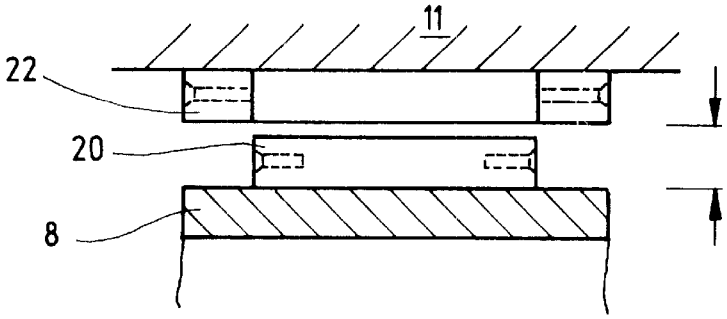
Figure 5:
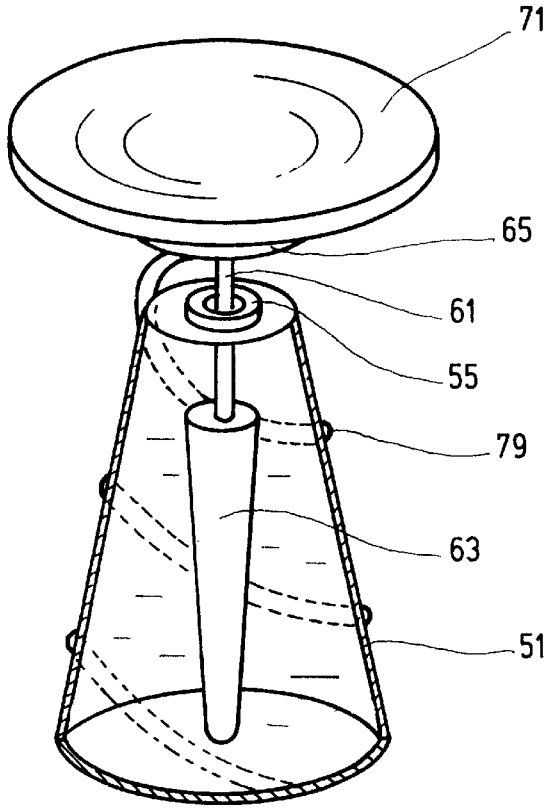
Figure 6:
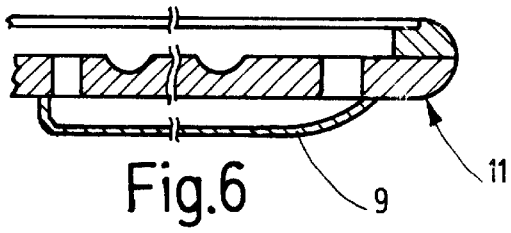

Having thus described the invention in general terms, reference will now be made to two exemplary embodiments illustrated by the accompanying drawings, which are not necessarily drawn to scale, and wherein:

FIG. 1 shows a side view, illustrated partly in section, of the first exemplary embodiment, FIG. 2 shows a vertical section in the region of the fastening of the play surface, along line II—II in FIG. 3, FIG. 3 shows a horizontal section in the region of the fastening of the play surface, along line III—III in FIG. 2, FIG. 4 shows a schematic diagram of the play surface being exchanged, FIG. 5 shows a perspective view, illustrated partly in section, of the second exemplary embodiment, and FIG. 6 shows a section through a modification of the first exemplary embodiment.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In the first exemplary embodiment, the play unit, which is designed as a play table, has a base designated as a whole by B. The base B has a steel plate 2 which is provided with felt gliders 1 on the underside, is set into a round stand 3 from beneath and is screwed to the stand 3 through the felt gliders 1. The steel plate 2 provides the play unit with the necessary stability. The stand 3 has, in the center, a vertical milled relief which continues as far as the steel plate 2 and into which a cylindrical, tubular upright 4 of the base B is inserted as base shank.

The tubular upright 4 has four bores in each case at three different heights/positions, namely at its bottom end, just beneath its top end and at its top end. Through the lowermost bores, the tubular upright 4 is screwed to the stand 3 from the inside. Through the central bores, a bottom spring fastening 5 is screwed to the tubular upright 4 from the outside, said spring fastening being designed as a disk made of wood-based material with the internal diameter of the tubular upright 4. The bottom end of a large spring element F has been fitted on the bottom spring fastening 5 beforehand by means of clamps, said spring element being designed as a helical spring made of spring steel and projecting straight upward in extension of the tubular upright 4.

Through the top bores, a bottom bellows fastening 6 is screwed to the tubular upright 4, said bellows fastening being flush with the top border of the tubular upright 4. The bottom bellows fastening 6 is designed as a ring and has a wall thickness of approximately 20 mm and an internal diameter which corresponds to the external diameter of the tubular upright 4. The heads of the screws, which are fitted from the inside, for fastening the bottom bellows fastening 6 are countersunk in order that, during installation, the spring element F can be pushed into the tubular upright 4 as far as the bottom spring fastening 5.

The bottom bellows fastening 6 serves for fitting the bottom border of the bellows 7 which is made of rubber and is designed as protection and as a damping element. The top end of the spring F is screwed, by means of clamps, to a top spring fastening 8, which is designed as a round disk with a diameter which corresponds to the external diameter of the bottom bellows fastening 6. The top border of the bellows 7 is also adhesively bonded to the top spring fastening 8 once the spring element F has been fastened.

A play surface 11, which is provided on its underside with a ball-return track 9 and a ball-lifting means 10, has a generally disk-like shape. The changeover system for fastening the play surface 11 is described at a later stage in the text. In the exemplary embodiment, the play surface 11 is arranged generally horizontally in the starting position, i.e. the normal is oriented in extension of the axis of the tubular upright 4. It should also be possible, however, for the play surface 11 to be fitted in an inclined manner. On its top side, the play surface 11 is provided along its circumference with a border 12 on which a disk-like, set-in and screw-connected, transparent covering 13 made of acrylic glass is seated, said covering protecting the play surface 11 from above. The peripheral regions of the border 12, of the play surface 11, of the stand 3 and, if appropriate, of the bottom bellows fastening 6, that is to say the accessible edge regions, are provided with radii in order to prevent any risk of injury by sharp edges.

A ball 14 as rolling element can move along ball running tracks 16, which are made in the material of the play surface 11, in the present case MDF panels which are provided with color through a number of layers. The material sections 17 of the play surface 11 which are located laterally alongside the ball running tracks 16 form a labyrinth for the ball 14. The spacing between the top side of these material sections 17 and the covering 13 is, for example, smaller than the diameter of the ball 14, in order to keep the ball in the ball running track 16.

The play unit constitutes a game of skill and dexterity in which the ball 14 is to be guided through the labyrinth via gravitational-force displacements by the play surface 11, and thus the spring element F being subjected to directed pressure, with resulting deflections out of the starting position. For example, beginning from a starting point in the vicinity of the border 12 of the play surface 11, the ball 14 can be guided to a target point in the center of the play surface 11. It drops, through a bore in the play surface 11 at the target point (or at other points), into the ball-return track 9 and is brought back to the start, where it is brought onto the top side of the play surface 11 again by the ball-lifting means 10. Instead of the ball-lifting means 10, in one modification, the ball-return track 9 may be guided obliquely in the direction of the starting point, as is indicated in the modification according to FIG. 6, the oblique slope being smaller than the usually achieved, maximum inclination of the play surface 11.

Different variants of the play surface 11 are envisaged for the play unit, for example different labyrinths, no labyrinth at all, a different number of balls, different rolling elements, such as cars or trains which roll through landscapes, return guides of different sizes, or different colors. For this purpose, the play surface 11 can be removed and exchanged in its entirety, together with a covering 13 and with the ball-return track 9 installed. For this purpose, the changeover system has, on the top side of the top spring fastening 8, a round disk 20, of which the diameter is approximately 40 mm smaller than the diameter of the top spring fastening 8. The centrally installed disk 20 has four horizontal, internally threaded blind holes 21 at a spacing of 90° on its lateral surface.

The counterpart for the disk 20 provided is a ring 22, which is fastened on the underside of the different variants of the play surface 11. The external diameter of the ring corresponds to the external diameter of the top spring fastening 8, while the internal diameter corresponds to the diameter of the disk 20. The ring 22 has four countersunk horizontal bores 22', which are aligned with the blind holes 21. Four screws 23 connect to one another in an exchangeable manner the ring 22 and the disk 20, and thus the play surface 11 and the base B with the spring element F as bearing device.

The second exemplary embodiment, which is illustrated in FIG. 5, is intended for outdoor use. The play unit has a conical, hollow base 51 made of plastic, which is filled with water 53 in order to stabilize it and to prevent it from being taken away. Provided at the tip of the base 51 is a joint 55, for example a cardan joint, which serves as a bearing device for a bar-like carrier 61. The carrier 61 has, beneath the joint 55, a restoring weight 63 which is arranged within the water 53 and the movements of which are damped by the water. The carrier 61 and restoring weight 63 may consist of steel and be encased by a plastic layer. The joint 55 may be protected by a flexible sheath.

A play surface 71 is fitted in an exchangeable manner above the joint 55 by means of a changeover system 65, which is designed in accordance with the first exemplary embodiment. The play surface 71, which is designed without a covering and is made of plastic, contains, for example, a labyrinth for a ball or some other variant. Instead of a return guide, the ball, as it reaches the target, passes onto a downward spiral 79, which leads downward on the outside of the base 51.

It is possible to have modifications of the exemplary embodiments in which the individual assemblies and components, as have been described above by way of example, are combined differently. For example, a modification of the second exemplary embodiment as a closed system may have a play surface with covering and ball-return guide.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A play unit, comprising:

a play table having a generally horizontal play surface mounted on a base via a bearing device so that the play surface can be moved relative to the base between a plurality of inclinations while mounted to the base, and at least one rolling element tat is guided and moves on the play surface in dependence on the inclination of the play surface, wherein the bearing device has a damping element.

2. A play unit according to claim 1, wherein the bearing device bears the play surface so that the play surface can be deflected in a predetermined range of inclinations relative to a starting position.

3. A play unit according to claim 2, wherein the bearing device has a spring element.

4. A play unit according to claim 2, wherein the bearing device has a joint.

5. A play unit according to claim 2, wherein the play surface is fitted releasably on the bearing device and can be exchanged as a module.

6. A play unit according to claim 2, wherein the rolling element moves within a closed system in the region of the play surface.

7. A play unit according to claim 2, wherein at least one return guide is provided on an underside of the play surface, and the rolling element can be moved along the return guide from a target point on the play surface to a starting point on the play surface.

8. A play unit according to claim 2, wherein provided on the top side of the play surface are regions of different heights which are for guiding the rolling element and are made in material which is of different colors at different heights.

9. A play unit according to claim 1, wherein the play surface is fitted releasably on the bearing device and can be exchanged as a module.

10. A play unit according to claim 1, wherein the rolling element moves within a closed system in the region of the play surface.

11. A play unit according to claim 1, wherein at least one return guide is provided on an underside of the play surface, and the rolling element can be moved along the return guide from a target point on the play surface to a starting point on the play surface.

12. A play unit according to claim 1, wherein provided on the top side of the play surface are regions of different heights which are for guiding the rolling element and are made in material which is of different colors at different heights.

13. A play unit, comprising:

a play table having a generally horizontal play surface mounted on a base via a bearing device so that the play surface can be moved relative to the base between a plurality of inclinations while mounted to the base, and at least one rolling element that is guided and moves on the play surface in dependence on the inclination of the play surface, wherein the bearing device has a bellows made of flexible material as a sheath.

14. A play unit according to claim 13, wherein the bearing device bears the play surface so that the play surface can be deflected in a predetermined range of inclinations relative to a starting position.

15. A play unit, comprising:

a play table having a play surface mounted on a base via a bearing device so that the play surface can be deflected in a predetermined range of inclinations relative to the base while mounted to the base, at least one rolling element that is guided and moves on the play surface in dependence on the inclination of the play surface, and a transparent covering mounted to the play table and spaced apart from the play surface so that the covering and the play surface cooperate to at least partially define an enclosure that the rolling element moves within, wherein the bearing device is covered by a sheath.

16. A play unit according to claim 15, wherein the bearing device has a spring element.

17. A play unit, comprising:

a play table having a play surface mounted on a base via a bearing device so that the play surface can be deflected in a predetermined range of inclinations relative to the base while mounted to the base, at least one rolling element that is guided and moves on the play surface in dependence on the inclination of the play surface, and a transparent covering mounted to the play table and spaced apart from the play surface so that the covering and the play surface cooperate to at least partially define an enclosure that the rolling element moves within, wherein the bearing device has a damping element.

18. A play unit, comprising:

a play table having a generally horizontal play surface mounted on a base via a bearing device so that the play surface can be moved relative to the base between a plurality of inclinations while mounted to the base, at least one rolling element that is guided and moves on the play surface in dependence on the inclination of the play surface, and a transparent covering mounted to the play table and spaced apart from the play surface so that the covering and the play surface cooperate to at least partially define an enclosure that the rolling element moves within while the rolling element rolls on the play surface; and at least one return guide is provided on an underside of the play surface, and the rolling element can be moved along the return guide from a target point on the play surface to a starting point on the play surface, wherein the enclosure, which the rolling element moves within while the rolling element rolls on the play surface, and the return guide define a closed system that prevents the user from removing the rolling element from the play unit, with the covering extending over both the starting point and the target point, so that the starting point and the target point are within the closed system that prevents the user from removing the rolling element from the play unit.

19. A play unit, comprising:

a play table having a generally horizontal play surface mounted on a base via a bearing device so that the play surface can be moved relative to the base between a plurality of inclinations while mounted to the base, and at least one rolling element that is guided and moves on the play surface in dependence on the inclination of the play surface, wherein provided on the top side of the play surface are regions of different heights which are for guiding the rolling element and are made in material which is of different colors at different heights.

20. A play unit according to claim 19, wherein he bearing device bears the play surface so that the play surface can be deflected in a predetermined range of inclinations relative to a starting position.

21. A play unit, comprising:

a play table having a generally horizontal play surface mounted on a base via a bearing device so that the play surface can be moved relative to the base between a plurality of inclinations while mounted to the base, at least one rolling element that is guided and moves on the play surface in dependence on the inclination of the play surface, and a transparent covering mounted to the play table and spaced apart from the play surface so that the covering and the play surface cooperate to at least partially define an enclosure that the rolling element moves within while the rolling element rolls on the play surface;

at least one return guide is provided on an underside of the play surface, and the rolling element can be moved along the return guide from a target point on the play surface to a starting point on the play surface, wherein the enclosure, which the rolling element moves within while the rolling element rolls on the play surface, and the return guide define a closed system that prevents the user from removing the rolling element from the play unit; and a ball-lifting means for lifting the rolling element from within the return guide to the starting point on the play surface, wherein the ball-lifting means is positioned within the return guide.

* * * * *